United States Patent [19]

Klockow

[11] 4,386,460

[45] Jun. 7, 1983

[54] METHOD OF MAKING MULTI-MEGOHM THIN FILM RESISTORS

[75] Inventor: Dennis H. Klockow, Andover, Mass.

[73] Assignee: Bell Telephone Laboratories, Incorporated, Murray Hill, N.J.

[21] Appl. No.: 263,786

[22] Filed: May 14, 1981

[51] Int. Cl.[3] ..... H01C 10/00

[52] U.S. Cl. ..... 29/593; 29/620; 338/195; 427/8; 427/101

[58] Field of Search ..... 29/620, 593; 338/195; 219/121 LH, 121 LJ; 427/8, 101

[56] References Cited

U.S. PATENT DOCUMENTS 4,146,957 4/1979 Toenshoff ..... 29/620

4,149,064 4/1979 Houska et al. ..... 29/620

4,172,249 10/1979 Szwarc ..... 29/620

4,209,764 6/1980 Merz et al. ..... 427/101

*Primary Examiner*—Carl E. Hall

*Assistant Examiner*—P. W. Echols

*Attorney, Agent, or Firm*—Lester H. Birnbaum

[57] ABSTRACT

A geometry and method of fabricating thin film resistors which are tolerant of faults in the film and therefore permit attainment of high resistances. The resistor includes a series of connected closed loops (15) each with a member (17) providing a short circuit path. Such members are successively cut and the change in resistance is determined after each cut. This change is compared to certain threshold values to determine the presence or absence of an open circuit fault in each loop. The resistor is then trimmed to its desired value by cutting only the loops where no opens have been discovered.

12 Claims, 5 Drawing Figures

METHOD OF MAKING MULTI-MEGOHM THIN FILM RESISTORS

BACKGROUND OF THE INVENTION

This invention relates to thin film resistors and in particular to a geometry and method of fabricating such resistors which permit attainment of high resistances.

Thin film resistors have long been important where precise resistance values are needed. A wide range of resistance values is presently available due to the ability to pattern generate and laser trim the resistor. However, present resistors have not generally exceeded 2–3 megohms in resistance. This is due to the fact that higher value resistances generally require either an excessively large pattern or a narrow line width (preferably approximately 12 μm for resistors formed on ceramic) which is more susceptible to faults producing either an open circuit or short circuit in the resistor. A short usually just requires additional trimming to correct, but a single open in the resistor pattern renders the resistor useless after laser trimming.

Thus, attempts to extend the resistance range upward create a greater probability of open circuit faults and result in significant yield problems.

It is, therefore, a primary object of the invention to provide a resistor geometry and method of fabrication which are tolerant of faults in the film, thereby permitting fine line patterns and high resistance values.

SUMMARY OF THE INVENTION

This and other objects are achieved in accordance with the invention which in one aspect is a method of fabricating on an insulating layer a thin film resistor including a series of loops electrically coupled between an input and output portion. Short circuit paths are provided for each of such loops. These paths are successively cut and the resulting change in resistance between input and output portions after each path is cut is measured and compared to a certain threshold, thereby indicating the presence or absence of an open circuit in that loop. A second cut is made only in the loops where no open circuit is indicated until a predetermined resistance for the resistor is achieved.

BRIEF DESCRIPTION OF THE DRAWING

These and other features of the invention will be delineated in detail in the following description. In the drawing.

Figure 1:
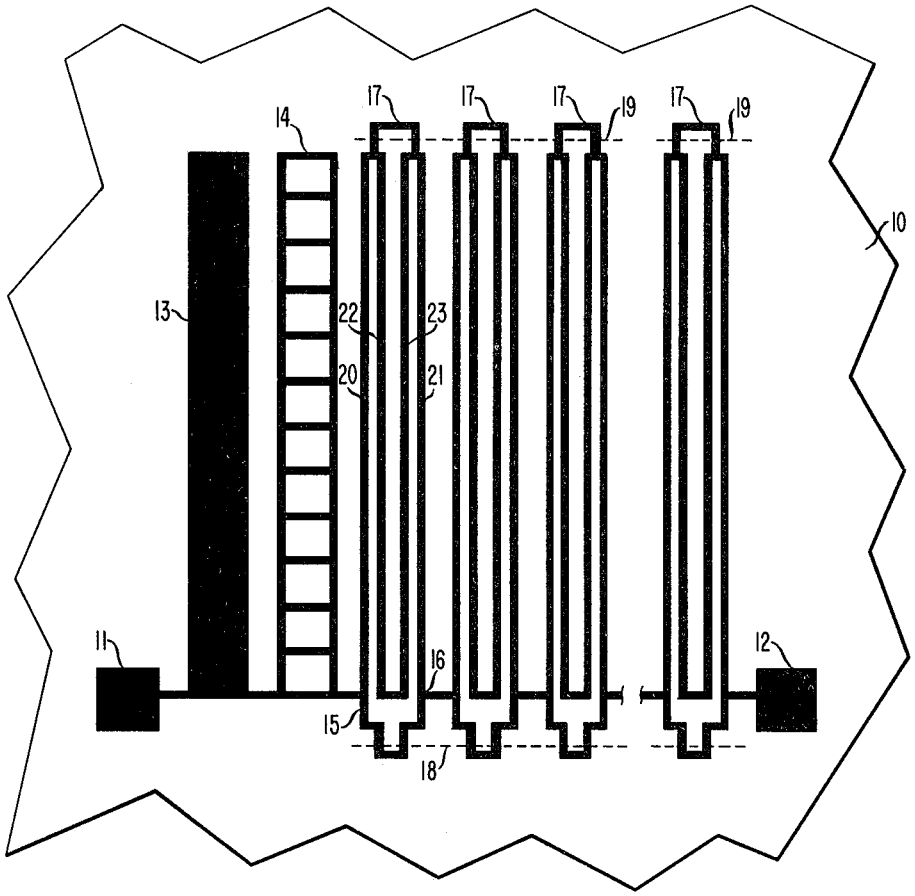
FIG. 1 is a plan view of a thin film resistor in accordance with one embodiment of the invention.

It will be appreciated that for the purpose of illustration these figures are not necessarily drawn to scale.

DETAILED DESCRIPTION

The basic principles of the invention will be described with reference to the thin film resistor illustrated in FIG. 1 and the equivalent circuit for a portion of the resistor depicted in FIG. 2.

The resistor is typically formed on a ceramic substrate, 10, such as alumina. However, the resistor can be formed on any insulating layer, including oxide layers formed over active silicon substrates (see, e.g., U.S. Pat. No. 4,344,223 issued to Bulger et al, and assigned to the present assignee).

The resistor was coupled between input and output portions, which in this case comprise termination pads 11 and 12, respectively. The resistor itself included a portion, 13, typically referred to as a "top hat," a portion, 14, usually referred to as a "ladder," and a series of closed loops, such as 15. The loops were electrically coupled by horizontal members, such as 16 thereby establishing for each loop an upper portion above the horizontal member and a lower portion below the member. Each upper portion included a double peak and a short circuit path, such as 17, electrically coupling the two peaks.

In this particular example, the resistor was made from a film of tantalum nitride, which was deposited on the substrate by sputtering to a thickness of approximately 300 Angstroms. The sheet resistance of the film was approximately 300 Ω/□. It will be understood that the invention is not limited to any particular thickness or composition of resistor film. In general, the sheet resistance for producing high resistance should fall within the range 200 to 500 Ω/□, while the thickness will be in the range 200 to 40 Angstroms. The area of the resistor in this example was approximately 0.28×0.28 inches.

As known in the art, the resistance per unit area of a thin film resistor is inversely proportional to the square of the line width of the film. Therefore, in order to produce a multi-megohm resistor, it is desirable to produce as small a line width as possible, preferably less than 25 μm. In this particular example, the line width was 15 μm, and was generated using standard projection printing or contact printing photolithographic masking and a chemical or plasma etching. While such line widths may be generated by state of the art techniques, faults producing open circuits are often formed in the loop portion of the resistor. Since such loops are successively cut along the line 18 to trim the resistor to a desired final value, a single open in one of the trimmed loops renders the circuit useless.

In accordance with one feature of the invention, therefore, narrow line widths can be attained for high resistances by means of a technique which identifies any open circuit faults in the loops. This was accomplished by successively cutting the short circuit paths, 17, along the line indicated as 19. The change in resistance between the input and output termination pads was measured as each short circuit path was cut. Each change in resistance was compared to certain threshold values which determined the appropriate resistance change for loops with and without open circuit faults. In this embodiment, the thresholds were determined based on the ratio (n) of the length of a leg of the upper portion of the loop to the length of the bottom portion of the loop. A "window" between threshold values therefore established the resistance change which would result if the short circuit path (17) of a loop without a fault had been cut. If the resistance change fell outside this window, the presence of a fault in the loop was indicated. Standard laser trimming would then proceed by cutting along line 18 only those loops where no open circuit fault was identified until the desired final resistance was obtained or it was determined that trimming should proceed to the top hat or ladder portions of the circuit.

The above principles are presented in more detail with reference to the circuit of FIG. 2 and in the following mathematical analysis. In FIG. 2, an equivalent circuit for two loops is shown with $R_{1-4}$ and $R_{5-8}$ representing the resistance of each leg in the upper portion of the loops, while R is the resistance of the lower portion. It will be appreciated that each of the resistances $R_{1-8}$ can be written as nR where n is the ratio of the height of the leg to the path length of the lower portion. Before the cut is made in the shorting member, 17, the resistance, $R_L$, of each loop which has no open circuit fault will be:

$$R_L = \frac{R(2nR)}{R + 2nR} \tag{1}$$

since the lower portion is in parallel with only two legs of the loop. This can be rewritten:

$$R_L = \frac{2n}{1 + 2n} R \tag{2}$$

If the loop has no open faults in the upper portion, after the cutting of member 17 the lower portion will be in parallel with all four legs. Consequently, the new resistance $R_L'$ will be:

$$R'_L = \frac{4n}{1 + 4n} R \tag{3}$$

The percent increase in resistance for a loop with no open fault is therefore:

$$\frac{\Delta R_L}{R_L} = \frac{R'_L - R_L}{R_L} = \frac{1}{1 + 4n} \tag{4}$$

Thus, for example, if the resistor is designed with n=10, the percent increase will be equal to 2.4 percent.

If there is an open circuit fault in one of the outermost legs, 20 or 21 ($R_1$ or $R_4$), of the loop, there will be no change in resistance for the loop when the shorting member is cut since there would be no current flow in the upper portion of the loop either before or after the cut. That is:

$$R_L = R_L' = R \tag{5}$$

If there were an open circuit fault in one of the inner legs, 22 or 23 ($R_2$ or $R_3$), of the loop then $R_L$ would again be $$\frac{2n}{1 + 2n} R$$

as in the case of a loop without a fault. However, after the shorting member is cut, the resistance, $R_L'$, would be equal to R since no current would flow in the upper portion after the cut. For such a loop, therefore, the change in resistance would be $$\frac{R'_L - R_L}{R_L} = \frac{1}{2n} \tag{6}$$

Again, if n=10, the change in resistance would be 5 percent.

If the loop had an open in the bottom portion, then the change in resistance after the cut would be 50 percent since two more resistances (e.g. $R_2$ and $R_3$) would simply be added in series to the resistances ($R_1$ and $R_4$) of the outermost legs as a result of the cut.

Thus, it will be appreciated that threshold values for change in resistance to identify a loop with and without a fault can be established. In the case of n=10, the window for a good loop could be equal to 1–4 percent (giving a range of approximately ±1.5 about the nominal value from equation 4). Any resistance change as a result of cutting the shorting member which is outside this range would indicate the presence of an open circuit fault in that particular loop.

Figure 2:
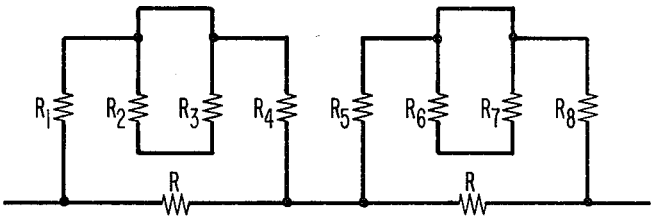
FIG. 2 is an illustration of a circuit which is essentially equivalent to a portion of the thin film resistor in accordance with the same embodiment.

As alluded to previously, after it has been determined which loops contain open circuit faults, the resistor was trimmed in a standard manner, except for the fact that the defective loops were not cut, by cutting along the line 18 of FIG. 1. In this example, the resistor had a value of 1 megohm prior to trimming and 30 loops were cut until a resistance of 20 megohms was achieved. The final resistance was achieved by trimming the top hat and ladder portions, 13 and 14, respectively. Utilizing the present invention, it is expected that final resistances in the range of 50 kilohms–100 megohms with resistor areas within the range of 0.0005–0.5 square inches can be achieved.

The particular means employed for cutting the resistor film was a standard YAG laser trimmer sold by ESI. Any laser trimmer can be utilized in accordance with the invention as long as the laser kerf is small enough to allow precise starting and stopping points so the loops can be trimmed selectively. In this case, the kerf was approximately 0.6 mils.

Figure 3:
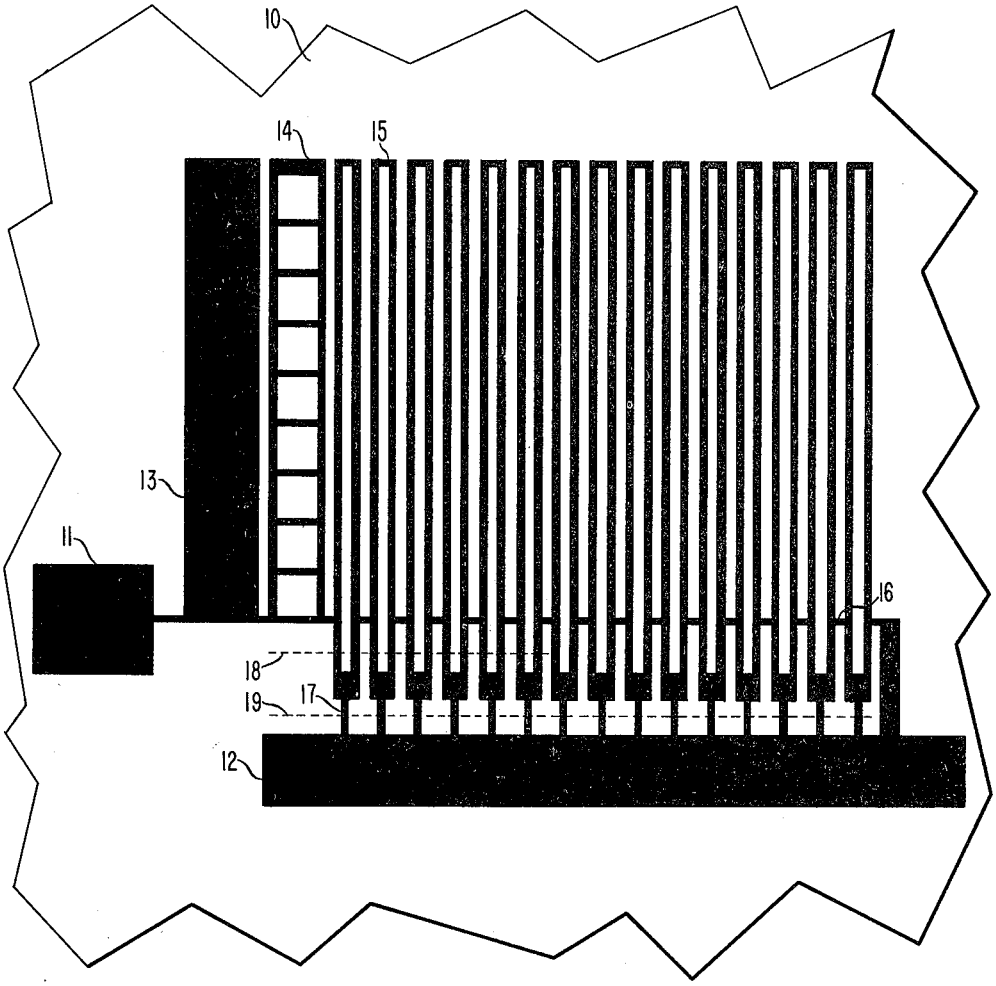
FIG. 3 is a plan view of a thin film resistor in accordance with a further embodiment of the invention.

FIG. 3 shows a resistor geometry in accordance with a further embodiment of the invention with elements corresponding to those in FIG. 1 being similarly numbered. In this embodiment, it will be noted that each loop 15, has only a single peak in the upper portion and that the shorting members, 17, electrically couple each loop to the termination pad 12. Again, the shorting members were successively cut along line 19 and the resulting change in resistance for each loop was measured. The change in resistance was compared to a certain threshold in order to identify which loops have open circuit faults, as before, and only loops without faults were trimmed by cutting along line 18. Here, however, the threshold was determined in a different manner than previously described.

Figure 4:
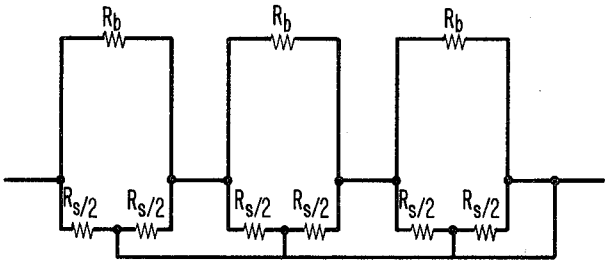
FIG. 4 is an illustration of a circuit which is essentially equivalent to a portion of the resistor shown in FIG. 3.

As shown in FIG. 4, a series of closed loops is equivalent to a series of parallel coupled resistors $R_b$ and $R_s$ where $R_b$ is the resistance of the portion of the loop above the horizontal connectors (16) and $R_s$ is the resistance of the portion of the loop below the connectors. The mean change in resistance, $\Delta R_{mean}$, caused by cutting the short circuit paths is therefore:

$$\Delta R_{mean} = \frac{R_b R_s}{R_b + R_s} \tag{7}$$

However, if a loop has an open circuit fault in the upper portion, the change in resistance when the path to that loop is cut will be equal to $R_s$. A reasonable threshold $\Delta R_{TH}$ can be set midway between these two values to give:

$$\Delta R_{TH} = \frac{1}{2}\left(\frac{R_b R_s}{R_b + R_s} + R_s\right) \quad (8)$$

Resistors are usually designed with a certain ratio of upper to lower path length for the loop. Thus $R_b/R_s$ is determined by the design. Equation (8) can therefore be written:

$$\Delta R_{TH} = \Delta R_{mean}\left(1 + \frac{1}{2m}\right) \quad (9)$$

where $m = R_b/R_s$. Thus, if the change in resistance for any loop, when the short circuit path is cut, is equal to or greater than the value set from equation 9, that loop will not subsequently be trimmed. In the example where $m = 10$, $\Delta R_{TH}$ is 5 percent above $\Delta R_{mean}$.

It will be noted that the above analysis does not include the case where there is an open circuit in the lower portion of a loop. This is not considered a relevant situation since the bottom portion of the loop will be trimmed anyway and whether trimmed or not current will flow in the top portion of the loop whenever there is a fault in the lower portion.

Figure 5:
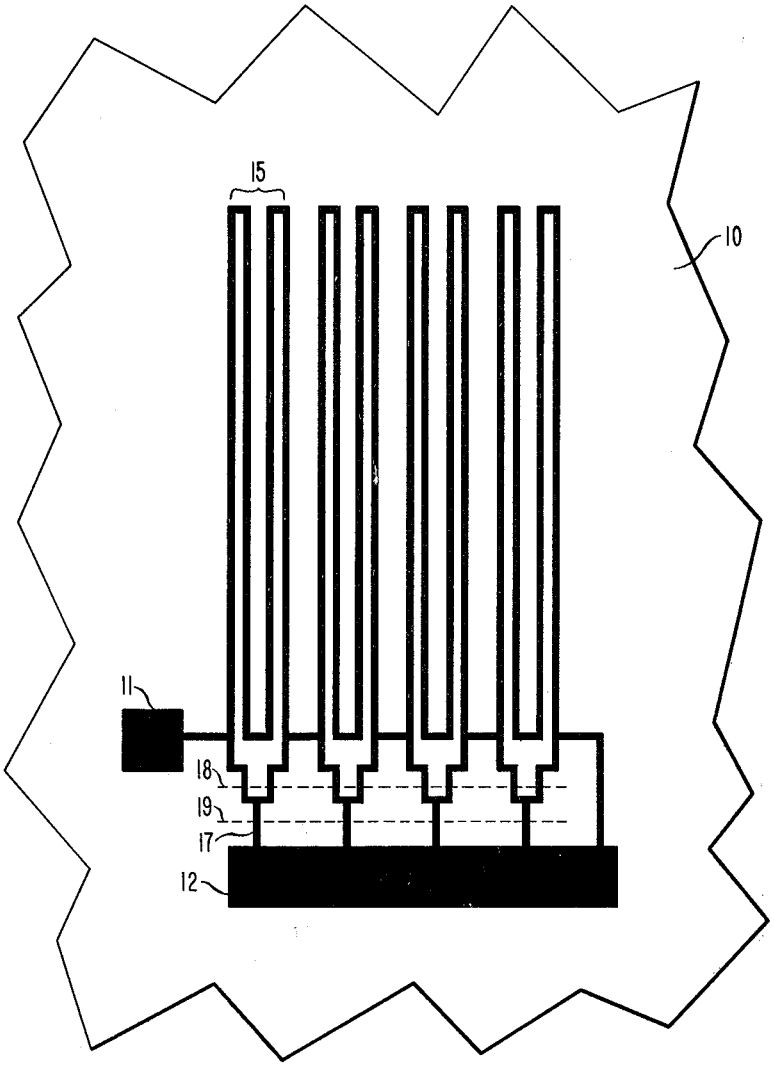
FIG. 5 is a plan view of a portion of a thin film resistor in accordance with a still further embodiment of the invention.

FIG. 5 shows a resistor loop geometry in accordance with a still further embodiment of the invention, again with elements corresponding to those of FIG. 1 being similarly numbered. It will be noted that this embodiment combines the double peak geometry of FIG. 1 and the shorting to the termination pad of FIG. 3. Determination of faults and trimming proceed as in the latter embodiment.

Various additional modifications will become apparent to those skilled in the art. All such variations which basically rely on the teachings through which the invention has advanced the art are properly considered within the spirit and scope of the invention.

What is claimed is:

1. A method of fabricating on an insulating layer (10) a thin film resistor including a series of closed loops (15) electrically coupled by horizontal connectors (16) between an input and output portion (11 and 12) where each loop comprises an upper portion above the connector and a lower portion below the connector characterized in the steps of providing, in addition to said closed loops, an individual short circuit path (17) for each of said loops, successively cutting each of said short circuit paths, measuring the resulting change in resistance between the input and output portions after each individual short circuit path is cut and comparing said change to a threshold value to determine the presence or absence of an open circuit in that loop, and successively cutting only the loops for which no open circuit is indicated until a desired resistance is achieved.

2. The method according to claim 1 wherein each loop consists of an upper portion above the connector with at least two peaks.

3. The method according to claim 2 wherein the short circuit paths electrically couple the two peaks of the upper portion.

4. The method according to claim 3 wherein threshold values are set about a nominal change in resistance ($\Delta R_L/R_L$) for a loop with no open fault calculated essentially according to the relationship:

$$\frac{\Delta R_L}{R_L} = \frac{1}{1 + 4n}$$

where n is the ratio of the length of a leg of the upper portion to the length of the bottom portion and $R_L$ is the resistance of the loop prior to cutting the short circuit path.

5. The method according to claim 1 wherein the short circuit paths electrically couple the loops to the output portion and the threshold value is determined from the mean change in resistance ($\Delta R_{mean}$) after cutting all paths.

6. The method according to claim 5 wherein the threshold value $\Delta R_{TH}$ is determined essentially from the relationship:

$$\Delta R_{TH} = \Delta R_{mean}\left(1 + \frac{1}{2m}\right)$$

where m is the ratio of the path length of the upper portion to the path length of the lower portion.

7. The method according to claim 1 wherein the line width of the resistor is less than 25 μm.

8. The method according to claim 1 wherein the final value of resistance for the resistor is within the range 50 KΩ–100 MΩ.

9. The method according to claim 1 wherein the short circuit paths and loops are cut by a laser.

10. The method according to claim 1 wherein the resistor comprises a tantalum nitride film formed on a ceramic substrate.

11. A method of fabricating on an insulating substrate (10) a thin film resistor having a final resistance greater than 50 kilohms and a line width less that 25 μm, said resistor including a series of closed loops (15) electrically coupled by means of horizontal connectors (16) between an input and output termination pad (11 and 12), where each loop comprises an upper portion above the connector and a lower portion below the connector characterized in that the upper portion of each loop comprises at least two peaks, an individual short circuit path, (17) in addition to said closed loops, is provided between the two peaks of each loop, threshold values for a loop without an open circuit fault are provided based on the ratio (n) between the length of a leg of the upper portion and the length of the lower portion, each individual short circuit path is cut and the resulting change in resistance between the input and output pads after each individual short circuit path is cut is measured and compared to the threshold values to determine the presence or absence of an open circuit fault in each loop, and only the loops for which no open circuit fault is indicated are cut until a desired resistance is achieved.

12. A method of fabricating on an insulating substrate (10) a thin film resistor having a final resistance greater than 50 kilohms and a line width less than 25 μm, said resistor including a series of closed loops (15) electrically coupled by means of horizontal connectors (16) between an input and output termination pad (11 and 12), each loop having an upper portion above the connector and a lower portion below the connector, characterized in the steps of providing, in addition to said closed loops, an individual short circuit path (17) between each loop and the output pad (12), successively cutting each of said short circuit paths and measuring the resulting change in resistance between the input and output pads after each individual short circuit path is cut, establishing a threshold value ($\Delta R_{TH}$) based on the mean change in resistance ($\Delta R_{mean}$) after all short circuit paths are cut, and successively cutting only the loops for which a change in resistance less than the threshold value was measured until a desired resistance is achieved.

* * * * *